US005974974A

United States Patent [19]

Agnew et al.

[11] Patent Number: 5,974,974

[45] **Date of Patent: *Nov. 2, 1999**

[54] SUBSTANTIALLY TRANSPARENT PRINTING BLANKETS AND METHODS FOR USING SAME

[75] Inventors: Brooks A. Agnew, Morristown, Tenn.; Roland Gaertner, Riedesheim, France; Robert Nabet, N. Chelmsford, Mass.

[73] Assignee: Polyfibron Technologies, Inc., Atlanta, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 08/886,224

[22] Filed: Jul. 1, 1997

[51] Int. Cl.[6] ..... B41K 1/50

[52] U.S. Cl. ..... 101/401.1; 101/382.1; 101/492; 101/376; 430/14; 430/271.1; 430/300; 430/329

[58] Field of Search ..... 101/401.1, 401, 101/389.1, 382.1, 492, 376; 430/14, 15, 271.1, 13, 286.1, 300, 329, 284.1; 428/317.3, 331; 156/240

[56] References Cited

U.S. PATENT DOCUMENTS

| | | | |
|---|---|---|---|
| Re. 34,933 | 5/1995 | Gager et al. | 428/331 |
| 3,964,389 | 6/1976 | Peterson | 101/401.1 |
| 4,135,960 | 1/1979 | Shuppert et al. | 156/240 |
| 4,162,919 | 7/1979 | Richter et al. | 430/271.1 |
| 4,292,150 | 9/1981 | Farber et al. | 430/286.1 |
| 4,323,636 | 4/1982 | Chen | 430/271.1 |
| 4,415,652 | 11/1983 | Proskow | 430/287.1 |
| 4,684,600 | 8/1987 | Worns et al. | 430/271.1 |
| 4,946,759 | 8/1990 | Tomita et al. | 430/286.1 |
| 5,264,289 | 11/1993 | Kondo et al. | 101/401 |
| 5,356,693 | 10/1994 | Tomono et al. | 101/401 |
| 5,410,963 | 5/1995 | Steadman | 101/376 |
| 5,476,712 | 12/1995 | Hartmann et al. | 428/317.3 |
| 5,544,584 | 8/1996 | Thompson et al. | 101/401.1 |
| 5,566,618 | 10/1996 | Frazzitta | 101/492 |
| 5,611,279 | 3/1997 | Ando et al. | 101/401.1 |
| 5,644,985 | 7/1997 | Serain et al. | 101/401.1 |
| 5,688,633 | 11/1997 | Leach | 430/284.1 |
| 5,715,750 | 2/1998 | Goovaard | 101/382.1 |
| 5,771,809 | 6/1998 | Hecht | 101/401.1 |

OTHER PUBLICATIONS

PCT International Search Report dated Aug. 19, 1998, 5 pages.

*Primary Examiner*—Eugene Eickholt
*Attorney, Agent, or Firm*—Woodcock Washburn Kurtz Mackiewicz & Norris, LLP

[57] ABSTRACT

Substantially transparent printing blankets are provided comprising a substantially transparent printing layer disposed upon a substantially transparent support layer. The substantial transparency of such printing blankets permits off-press introduction of knock-out areas. In certain embodiments, this is accomplished by disposing the support layer of the printing blanket adjacent to a substrate which bears either an image to be printed or some other print transfer information (such as a negative) corresponding to the image. The print transfer information then is viewed through the printing blanket to identify portions of the underlying substrate which bear information indicating that print should not appear on a corresponding portion of the coated substrate. After such portions are identified, the printing layer is removed from the support layer in those areas of the printing blanket which are adjacent to the identified portions of the substrate.

28 Claims, 4 Drawing Sheets

SUBSTANTIALLY TRANSPARENT PRINTING BLANKETS AND METHODS FOR USING SAME

FIELD OF THE INVENTION

The present invention is directed to printing blankets and, more particularly to substantially transparent printing blankets and to novel processing methods which are made possible by the blankets' substantial transparency.

BACKGROUND OF THE INVENTION

Printing blankets are used for direct, in-line coating in lithographic printing processes equipped with coating towers or coating units to apply gloss and/or matte overcoats at various levels on a variety of substrates, including corrugated stock, plain board, paper, film, foil, and laminates. The coating apparatus is used to apply these coatings principally in three situations: (i) when the entire substrate is to be coated; (ii) when the entire substrate is to be coated with the exception of certain areas where the coating will interfere with the adhesion of glue, printed labels, stamps, bar codes, or other such markings; and (iii) when certain, selected areas of the substrate are to be coated. The processes performed in situation (ii) are commonly referred to in the industry as "knock out" coating processes, whereas those performed in situation (iii) are commonly referred to spot coating processes.

One current practice in the industry in situation (ii) is to transfer an image to be printed directly onto a metal plate and mount a transparent printing blanket consisting of a polymeric support layer and a non-strippable polymer directly onto the plate using a suitable adhesive. Once mounted, the pressman uses a hand-held knife to carefully cut through the blanket, and then removes the entirety thereof (i.e., both the cured polymer and support) from the plate in portions thereof which are not to receive the coating. The plate/blanket composite which ultimately is produced then is mounted onto the plate cylinder of the coating apparatus, and is used to transfer coating to a printing blanket (mounted on a blanket cylinder) which, ultimately, transfers the coating to the substrate.

Another current practice in situation (ii), which avoids use and preparation of the printing cylinder, is to use rubber offset printing blankets as strippable coating blankets on the printing cylinder. These printing blankets typically consist of an opaque rubber printing layer disposed upon an opaque fabric support. Such a blanket is stretched slightly, mounted on a press, and an image corresponding to that ultimately to be coated is outlined with ink on the rubber surface using a lithographic printing plate. The pressman then uses a hand-held razor knife to carefully cut through the rubber surface of the blanket without penetrating through and damaging the support. The pressman then hand strips the cut rubber areas off the blanket. This requires a high skill level and that the press be stopped for, on average, about 45 minutes. If the support is pierced with the razor knife, the blanket typically is removed and the process started over. The "stripped" coating blanket which ultimately is produced is not reusable, as its fabric layer relaxes slightly upon removal from the press. Thus, the stripping process must be repeated for each, individual coating job.

Given these considerations, it is clear that any product which would allow a stripped coating blanket to be prepared off-line (thus sparing valuable press time), would allow for easy cutting and stripping of the printing surface, and/or would allow for reuse of the blanket thus prepared would yield significant advantages in terms of cost, convenience, and coating quality. The apparent need for such a product, however, still remains unfilled.

OBJECTS OF THE INVENTION

It is one object of the present invention to provide substantially transparent printing blankets.

It is another object of the invention to provide such printing blankets in a form that is compatible with a variety of coatings, including aqueous and photocurable coatings.

It is another object to provide such printing blankets in a hydrophillic form that is compatible with oil-based lithographic inks.

It is a further object to provide methods for processing such printing blankets prior to mounting them on a press.

It is still another object to provide methods that involve cutting, stripping or otherwise removing portions of the printing layer off-press to produce relief ("knock out") areas which will not transfer coating to selected areas of the coated object.

It is yet another object to provide dimensionally-stable printing blankets which can be remounted and reused for a given type of print job.

BRIEF DESCRIPTION OF THE INVENTION

These and other objects are satisfied by the present invention, which provides novel printing blankets and methods for using same to selectively transfer coatings to substrates.

In one aspect, the invention provides substantially transparent printing blankets comprising a substantially transparent printing layer having first and second opposing surfaces, the first surface being disposed upon a substantially transparent support layer. The printing layer preferably is formed from a polymer having sufficiently high structural integrity and/or sufficiently low adhesion to the support layer that a portion thereof having length of about 0.25 inches and width of about 0.25 inches remains substantially intact when manually stripped from the support layer. One advantage of such printing blankets is that their substantial transparency permits off-press introduction of knock-out areas. In certain embodiments, this is accomplished by placing the support layer of the printing blanket next to a substrate which bears either an image to be printed or some other form of print transfer information (such as a negative) corresponding to the image. The print transfer information then is viewed through the printing blanket. In this way, one is able to identify portions of the underlying substrate which bear information indicating that print should not appear in a corresponding portion of the printed object. After such portions are identified, the printing layer is removed (stripped) from the support layer in those areas of the printing blanket which are adjacent to the identified portions of the substrate. The stripped coating blanket thus produced can then be mounted on the printing cylinder of a coating apparatus.

The present invention further provides composite structures produced in accordance with the foregoing methods. These composites generally comprise a substantially transparent printing blanket according to the invention which is adjacent to a substrate bearing print transfer information corresponding to an image to be printed. The printing layer has been removed from those portions of the support layer which are adjacent to the portions of the substrate which bear information indicating that print should not appear in a corresponding portion of the printed object. In certain embodiments, ink, pencil, knife marks or some other type of suitable information is recorded on the printing layer on or around portions thereof which are to be removed.

BRIEF DESCRIPTION OF THE DRAWINGS

The numerous objects and advantages of the present invention may be better understood by those skilled in the art by reference to the accompanying non-scale figures, in which.

DETAILED DESCRIPTION OF THE INVENTION

Figure 1:
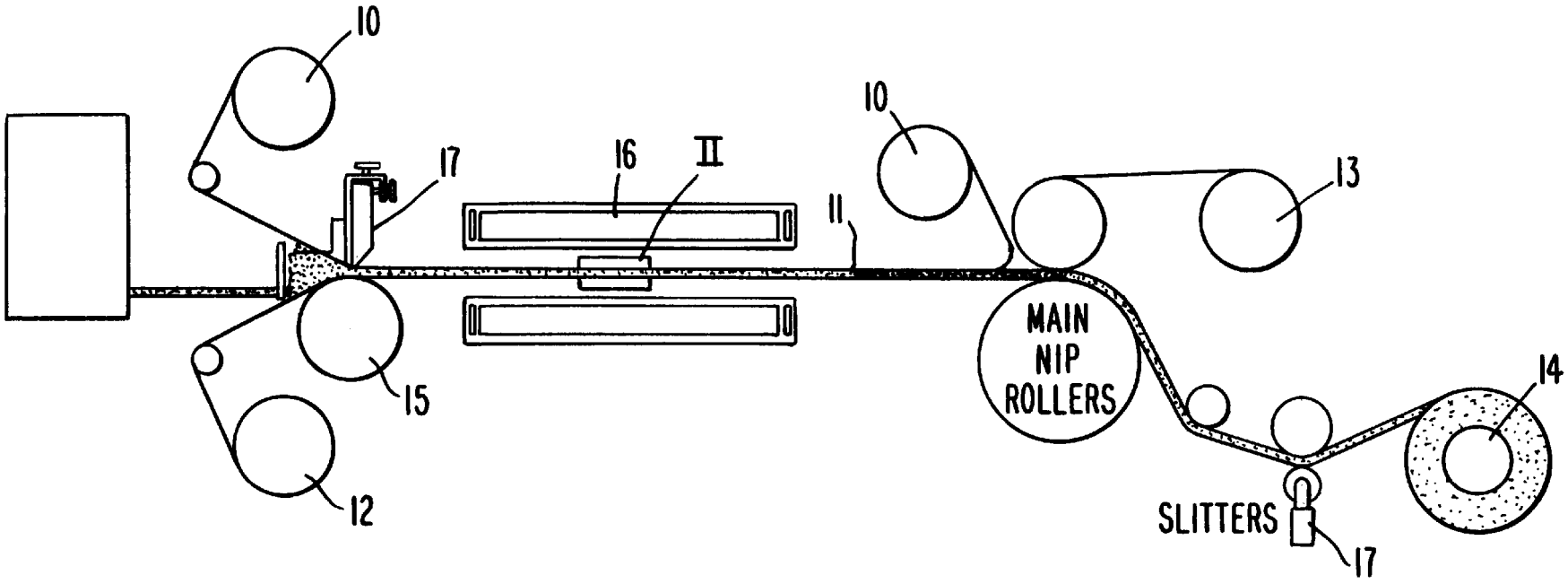
FIG. 1 is a cross-sectional view of a coating process according to the invention.

The present invention provides substantially transparent printing blankets which individually comprise a substantially transparent printing layer disposed upon a substantially transparent support layer. Substantially transparent materials according to the invention are those which have the property of transmitting light in such a way that a normal, human eye (i.e., one belonging to a person with so-called "20/20" vision) or a suitable viewing device can see through the material distinctly. The level of transparency should generally be one which permits a normal, human eye to distinguish objects having length and width on the order of at least 0.5 inches.

Support layers according to the invention can be formed from virtually any substantially transparent material. Preferred materials are those which are flexible, including polymeric materials such as polyethylene terephthalate and polyethylene naphthalate. Particularly preferred are polyethylene terephthalate films (including the ICI 226, ICI 561, Hoechst RN350, Hoechst 4407, and DuPont MYLAR brands) having thickness on the order of about 0.010–0.014 inches.

Printing layers according to the invention likewise can be formed from virtually any substantially transparent polymer. The printing layer preferably is formed from a fully cured polymer (i.e., a polymer having substantially no reactive linkage sites). Preferred polymers are those that can be processed to have a polar, matte surface and a Shore A durometer of 35–45 (see, e.g., ASTM Designation: D2240-91). Polar surfaces according to the invention are those which include polar covalent bonds, that is, covalent bonds (as, for example, C–O) wherein the bonding moieties assume substantial charged character. Matte surfaces according to the invention are those which appear smooth but lack gloss or luster due to surface roughness on the order of 1000 grit (grain size) abrasive material. Certain printing layers according to the invention are formed from elastomeric polymers, particularly those produced via photopolymerization. Representative elastomeric polymers include polyurethanes, polyethers and acrylonitriles. Preferred elastomeric polymers are those disclosed in U.S. patent application No. 08/708,805 filed on Sep. 9, 1996, entitled Aqueous Developable Photosensitive Polyurethane-Methacrylate. Representative of the preferred elastomers are the 150 SPD and SPL-2 brands of liquid photopolymers, which are commercially available from Polyfibron Technologies, Inc., Atlanta, Ga.

The printing blankets of the invention can include multiple support layers and multiple printing layers, so long as such layers are substantially transparent, and can further include an adhesive between the printing layer and the support layer and/or a layer of pre-expanded polymeric microspheres to enhance compressibility. Representative adhesives include the PERMACOLOR IP2099 and G050896A adhesives. Representative microspheres include the EXPANCEL brand of, for example, acrylic and PVC microspheres.

The printing blanket should, in any event, be one in which the level of adhesion between the printing layer and the support layer is low enough that portions of the printing layer can be removed from the support layer to facilitate introduction of knock-out areas, yet high enough that the printing blanket ultimately produced can sustain mechanical stress such as that typically imposed during the printing process. The printing layer, the support layer, and any adhesive or other materials therebetween should be selected such that a portion of the printing layer having length of at least about 0.25 inches and width of at least about 0.25 inches remains substantially intact when manually stripped from the support layer. It will be recognized that substantially intact materials according to the invention are those which include at least about 80 weight percent of their original composition, and that manual stripping procedures include those wherein a clamp, tweezer, pliers, or some other type of hand tool is employed to grip the stripped portion of the printing layer. While not wishing to be bound by any particular theory, it is believed that, for most types of polymers suitable for use in the printing layer, the level of adhesion between the printing layer and the support layer should be no greater than about 3 pounds per linear inch ("PLI").

In accordance with the invention, substantially transparent printing blankets are placed upon substrates which bear print transfer information corresponding to an image to be printed. Representative substrates include paper, metals, and plastics bearing print transfer information in the form of the image itself (recorded, for example, in ink, pencil, embossment, or some other recording medium), a negative thereof, or some other visually perceptible information (such as, for example, an outline or schematic) intended to correspond to the image. As will be recognized, the information borne on the substrate should differ from that ultimately to be printed to take account of elongation of the printing blanket that likely will occur during the printing process.

Because the printing blankets of the invention are substantially transparent, a user should actually be able to view the print transfer information through the printing blanket and, thus, identify portions of the printing layer which should be removed from the blanket in order to ultimately create a printed image corresponding to that appearing on the substrate. For example, in instances where the substrate bears an ink pattern corresponding to the image itself, one will remove portions of the printing layer which overlay portions of the substrate which bear no ink/coating. By contrast, in instances where the substrate bears a negative corresponding to the image, one will remove portions of the printing layer which overlay clear portions of the negative. In this way, one configures the printing blanket to receive a print medium (such as an aqueous coating) on selected portions of the printing layer and to deliver the print medium to an object, thereby producing a desired image on the object. The terms "coating" and "printing," are used herein in a nearly interchangeable manner, differing in scope principally in the sense that a "coating" process can be viewed as a specific type of "printing" wherein the print medium is applied to major portions of the printed object.

The printing blankets of the invention can be used to deliver a wide variety of print mediums. Indeed, virtually any liquid material can be delivered using such printing blankets. Preferred liquids are those that do not alter the physical and/or chemical properties of the printing layer, support layer, and/or other components of the blanket. Such liquids include conventional inks, photocurable materials, water-soluble coatings, matte coatings, semi-gloss coatings, and gloss coatings.

In certain embodiments of the present invention, the steps of viewing the substrate through the printing blanket, identifying portions thereof, and removing appropriate portions of the printing layer are performed by a human being. In these embodiments, it is preferred to record print transfer information corresponding to an image to be printed directly on the printing layer such as, for example, by tracing such information with a pen or pencil, or by scoring the surface of the printing layer with a razor or knife. Once this has been done, one removes the printing layer through any suitable means. In preferred embodiments, this is done by cutting into the printing layer with a razor or knife and then manually stripping away the printing layer. As will be recognized, removal of an identified portion of the printing layer should be as complete and precise as possible. In the resulting printing blankets, the demarcations between portions thereof that do and do not bear printing layer should be sharp, and there should be a minimum of residual printing layer on portions of the printing blanket not intended to bear any of the printing layer.

In other embodiments, the steps of viewing the substrate through the printing blanket and identifying portions of the printing layer to be removed are performed in an automated or semi-automated manner with the assistance of suitable machines. The identifying step, for example, can generally be performed by a device comprising viewing means in electrical communication with control means to, for example, correct for elongation. The identifying step can be performed by cutting the printing layer with a device comprising cutting means in electrical communication with a control means such as a computer-aided design (CAD) system. In these embodiments, one can also transfer information corresponding to an image to be printed directly onto the printing layer using, for example, an ink jet printer, a pen-plotter, or any other suitable device for printing, embossing, scoring, cutting, or otherwise altering the printing layer's physical appearance.

In preferred embodiments, the present invention involves the production and application of a ready to use, strippable, fully cured, photopolymer printing blanket. The photopolymer is deposited in liquid form at 100% solids between a silicone-coated matte-finish polyester and an optically clear polyester carrier film which is wide enough to contain the width of the web coating and strong enough to withstand more than about one million impressions at nominal torque, press squeeze, and speeds. This composite is a moving web which passes over a precision roller and simultaneously under a doctor blade on a "knife-over-roll" (or "precision") nip coater to produce a precision caliper of coating.

The composite preferably is fully cured in-line (to provide the finished caliper) and the silicone-coated matte finished film is removed in-line to produce a matte-textured coating surface. The product is collected on a roll, which is slit to precision width, rewound, and inspected, as required.

In certain preferred embodiments, the printer cuts the desired amount of printing blanket off the roll and places it on a flat surface over a facsimile of the image to be coated. While holding the printing blanket securely, the printer cuts through the printing layer down to the support layer as he traces the outline of the knock-out areas (i.e., the areas which correspond to the portions in the printed object which are not intended to bear any coating). The printer manually removes the polymer areas as needed, and the printing blanket is ready to be mounted and used for coating.

In other preferred embodiments, the printer cuts the desired amount of printing blanket off the roll and places it into a cutter field of a suitable computer-aided device. The desired pattern is then loaded into the means controlling the cutter and the polymer knock outs are outlined automatically. The printer then removes the knock outs and the product is ready for mounting on the press.

Because an additional carrier sheet is not necessary in accordance with the invention, the printing blankets produced thereby can be immediately punched for registration, if needed, and clamped into the press cylinder without the need for additional buildup to accommodate most coater clamps.

Figure 2:
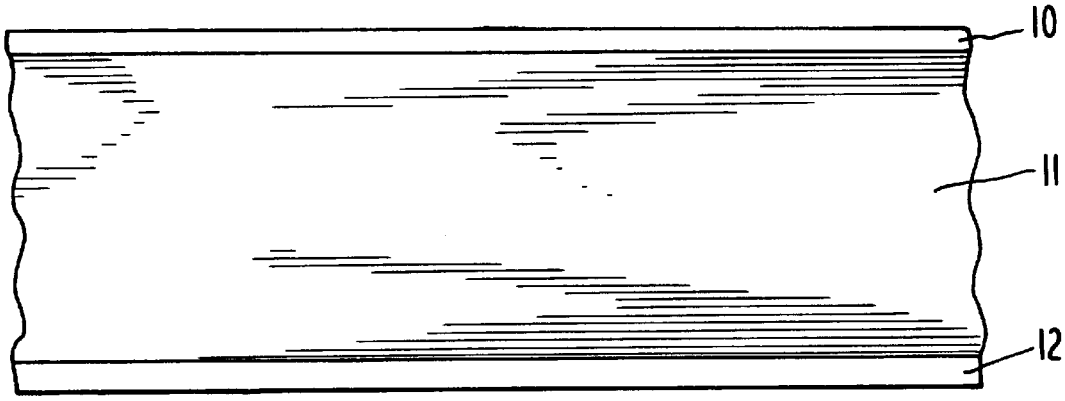
FIG. 2 is a side view of the element designated by outline II in FIG. 1.

FIG. 1 shows a representative process for preparing printing blankets in accordance with the present invention wherein photopolymer 11 is deposited onto support layer 12 with a pump and drawn into a gap between a matt-finished silicone coated polyester 10 and the support layer 12. The gap is maintained by a doctor blade 17 and a precision ground roller 15. The print surface is formed by curing the liquid photopolymer with UV radiation applied against the mattfinished silicone coated polyester 10 immediately after the doctor blade 17 by UV fluorescent bulbs 16. A side view of this element is shown in FIG. 2.

Figure 3:
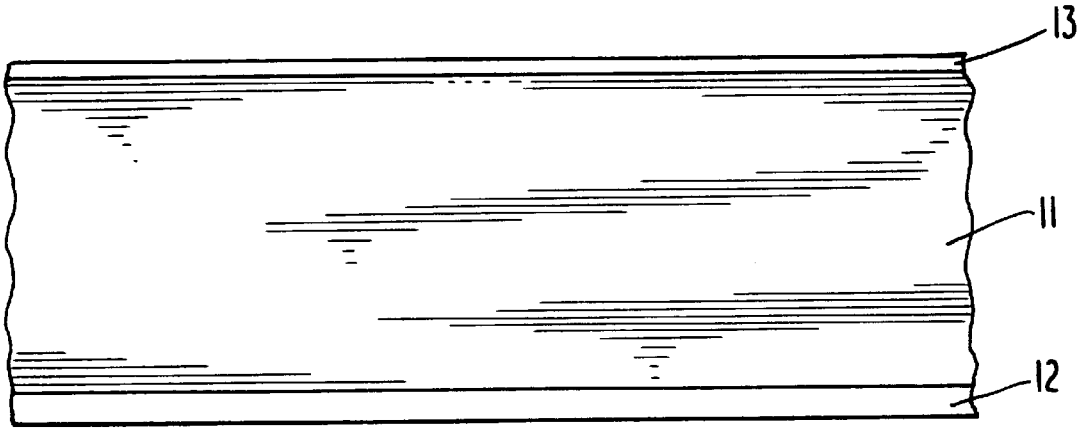
FIG. 3 is a side view of a printing blanket according to the invention bearing a polyethylene protective cover film.

The matt-finished film is removed after curing is complete and replaced with a polyethylene interleaf 13 to protect the print surface as it is slit to width and collected on a cardboard core 14. A side view of this element is shown in FIG. 3.

Figure 4:
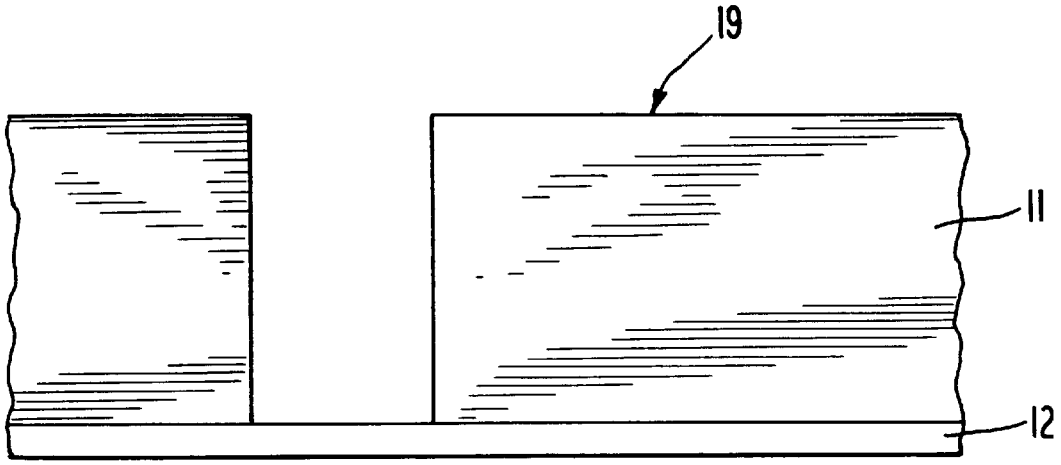
FIG. 4 is a side view of a printing blanket according to the invention in which portions of the blanket have been removed from the support layer.
Figure 5:
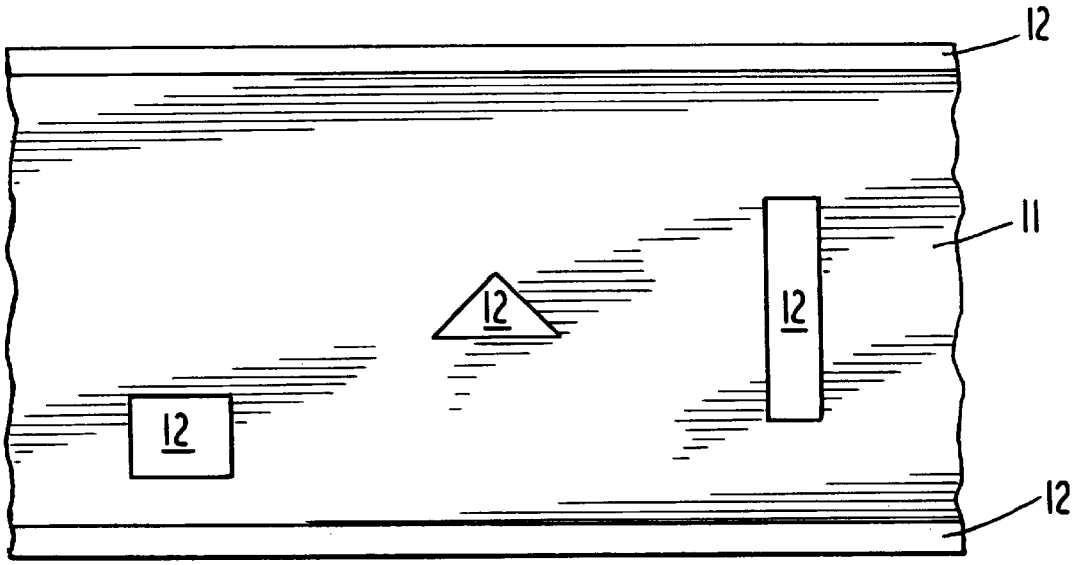
FIG. 5 is a top view of a printing blanket according to the invention in which portions of the blanket have been removed from the support layer.

Should an adhesive be needed to keep the cured photopolymer 11 from delaminating from the support layer sheet 12 during printing or cleaning, an adhesive layer can be applied onto the support layer 12 just prior to depositing the liquid uncured photopolymer 11. The fully prepared and stripped final product, as shown in FIGS. 4 and 5, preferably is placed into a heated environment for 5 to 10 minutes to thermally activate the adhesive. Prior to this heating, the adhesive preferably has a greater affinity for the cured photopolymer 11 than for the polyester support layer 12. This results in a clean support layer surface 12 when the cured photopolymer 11 is stripped, and a stronger bond after sufficient heating.

Figure 6:
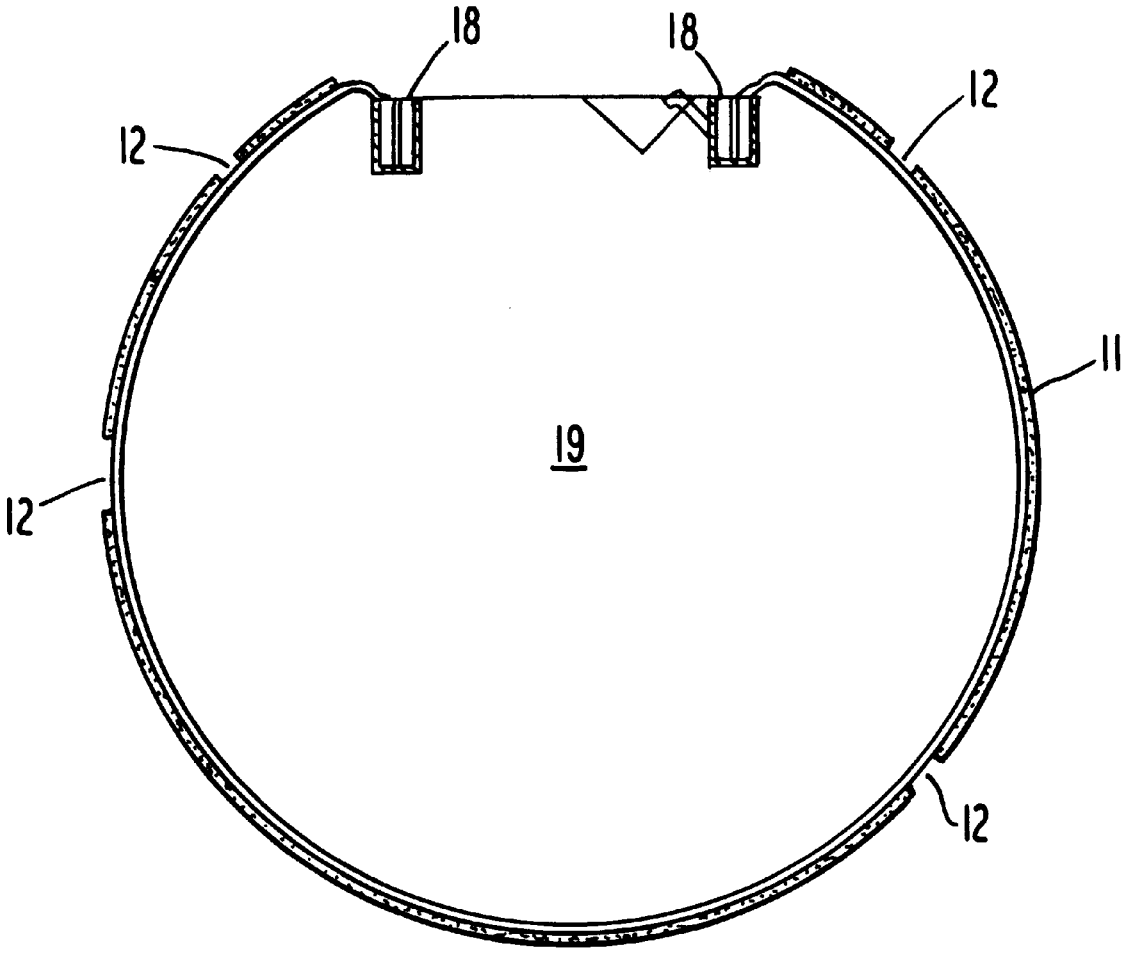
FIG. 6 is a side view of a printing blanket according to the invention mounted on a tower coater using clamping bars.

The printing blanket thus prepared can be affixed with clamping bars 18 and mounted to a press print cylinder 19, as shown in FIG. 6, and tightened over various buildup packing materials to bring the coating surface in contact with the print media.

Additional objects, advantages, and novel features of this invention will become apparent to those skilled in the art upon examination of the following examples thereof, which are not intended to be limiting.

EXAMPLE 1

ICI 561 brand polyester was loaded over the precision roller of a PREMIER brand coater as the support layer at about 51 inches width. The top film was 48 inch wide Hoechst 4407 (or DuPont MYLAR D) film coated with a silicone matte finish (under the precision doctor blade). This was loaded to pass between three separate banks of UV fluorescent bulbs of about 3 mw/cm$^2$ intensity as measured on a International Light IL 745-A meter and a XR 140-B sensor. Polyfibron Technologies 150 SPD liquid photopolymer was poured manually onto the moving web so as to be drawn into a precision gap formed by the doctor blade and the lower precision roller. The viscosity of the photopolymer was about 30,000 centipoise at 23° C. (room temperature). The gap was set at 50 mils and produced a strippable 45 mil printing blanket. The cured photopolymer was smooth and dry to the touch and translucent. The composite was cut into sheets at the end of the coater and stacked. When placed on press, the transfer of aqueous gloss primer coating was 5 to 15 points better than conventional, non-transparent, offset printing blankets. Using a UV-curable acrylate-based coating (i.e., Northwest SUNCURE® brand), the gloss transfer was about equal to such conventional printing blankets. The blanket's surface swelled and became tacky when exposed to these monomers.

EXAMPLE 2

The general procedure set forth in Example 1 was repeated using Polyfibron Technologies SPL-2 photopolymer. The resulting product was mounted on aluminum and used as a tower coating printing blanket. The transfer of aqueous gloss primer coatings (such as the ANCHOR, NORTHWEST and INX brands) was superior to conventional offset printing blankets and equal to the 150 SPD product. Using UV curable acrylate-based coatings (i.e., Northwest SUNCURE® brand), the gloss transfer was at least 18 points better than non-transparent, offset printing blankets. The surface of the blanket swelled and became tacky when exposed to the monomers.

EXAMPLE 3

The general procedure set forth in Example 2 was repeated except that an acrylate-capped form of the SPL-2 photopolymer was used which would be more compatible with uv acrylate monomers. The "capped" photopolymer was produced by reacting the SPL-2 product with polypropylene glycol monomethacrylate (PPGMMA) in the absence of methyldiethanolamine (MDEA). The altered liquid photopolymer had a viscosity of about 400,000 centipoise at 23° C., and was heated to about 60° C. before coating to help the material flow at about 30,000 centipoise into the gap on the coater. This composite was fully cured with UV radiation at 13 mw/cm$^2$ intensity in about 3.5 minutes. The coating surface was smooth and tack free upon removal of the cover sheet. The product was strippable with adhesion values less than 1 P.I., but required an additional adhesive tie coat to increase the bond strength between the photopolymer and the polyester carrier film to withstand the stresses on press. The product exhibited swell of less than 7%. when exposed to the acrylate monomer 1,6-hexanediol dimethacrylate, and was compatible with the SUNCURE® brand coating.

EXAMPLE 4

The general procedure set forth in Example 1 was repeated except that the viscosity of the 150 SPD photopolymer was reduced to about 20,000 centipoise by heating it in a 40° C. over for 24 hours. The gap was set to produce a fully cured, strippable blanket having 35 mils of photopolymer. The product was collected in rolled form at the end of the coater, rewound into 20 yard rolls, and slit to the desired width.

EXAMPLE 5

The general procedure set forth in Example 1 was repeated except that the final product was cured in the absence of oxygen and upon exposure to small amounts of UV radiation in the 350–370 nm range starting at about 3 mw/cm$^2$ and increasing to about 20 mw/cm$^2$.

Those skilled in the art will appreciate that numerous changes and modifications may be made to the preferred embodiments of the invention and that such changes and modifications may be made without departing from the spirit of the invention. It is therefore intended that the appended claims cover all such equivalent variations as fall within the true spirit and scope of the invention.

What is claimed is:

1. A substantially transparent printing blanket comprising:

a substantially transparent printing layer having first and second opposing surfaces; and a substantially transparent support layer; wherein:

said printing layer is formed from a fully cured polymer;

said first surface of said printing layer is disposed upon said support layer; and a portion of said printing layer having length of about 0.25 inches and width of about 0.25 inches remains substantially intact when manually stripped from said support layer.

2. The printing blanket of claim 1, wherein said printing layer is formed from an elastomeric polymer.

3. The printing blanket of claim 1 wherein said elastomeric polymer is selected from the group consisting of polyurethanes, polyethers, and acrylonitriles.

4. The printing blanket of claim 1 wherein said second surface is polar.

5. The printing blanket of claim 1 wherein said second surface is a matte surface.

6. The printing blanket of claim 1 wherein said second surface has a Shore A durometer of 35–45.

7. The printing blanket of claim 1 wherein said support layer is formed from polyethylene terephthalate or polyethylene naphthalate.

8. The printing blanket of claim 1 wherein said printing blanket further comprises an adhesive or polymeric microspheres between said printing layer and said support layer.

9. A method comprising the steps of:

providing a substantially transparent printing blanket which comprises a printing layer disposed upon a support layer;

disposing said support layer of said printing blanket adjacent to a substrate which bears print transfer information corresponding to an image to be printed;

viewing said print transfer information through said printing blanket;

identifying portions of said substrate bearing information which indicates an absence of print in said image to be printed; and removing said printing layer from said support layer in portions of said printing blanket which are adjacent to said identified portions of said substrate.

10. The method of claim 9 wherein said printing layer is formed from an elastomeric polymer.

11. The method of claim 9 wherein said elastomeric polymer is selected from the group consisting of polyurethanes, polyethers, and acrylonitriles.

12. The method of claim 9 wherein said support layer is formed from polyethylene terephthalate or polyethylene naphthalate.

13. The method of claim 9 wherein said printing blanket further comprises an adhesive or polymeric microspheres between said printing layer and said support layer.

14. The method of claim 9 wherein said print transfer information comprises said image to be printed.

15. The method of claim 9 wherein said print transfer information comprises a negative of said image to be printed.

16. The method of claim 9 further comprising recording print transfer information corresponding to an image to be printed on said printing blanket prior to performance of said removing step.

17. The method of claim 16 wherein said print transfer information comprises an outline of said portion of said printing layer to be removed.

18. The method of claim 9 wherein said removing step comprising cutting said printing layer.

19. The method of claim 9 further comprising applying a print medium to portions of said printing layer disposed upon said support layer following said removing step.

20. A composition comprising:

a substantially transparent printing blanket which comprises a printing layer disposed upon a support layer;

a substrate adjacent to said support layer of said printing blanket, said substrate bearing print transfer information corresponding to an image to be printed; wherein: substantially no printing layer is disposed upon portions of said support layer which are adjacent to portions of said substrate bearing information indicating an absence of print in said image to be printed.

21. The composition of claim 20 wherein said printing layer is formed from an elastomeric polymer.

22. The composition of claim 20 wherein said elastomeric polymer is selected from the group consisting of polyurethanes, polyethers, and acrylonitriles.

23. The composition of claim 20 wherein said support layer is formed from polyethylene terephthalate or polyethylene naphthalate.

24. The composition of claim 20 wherein said printing blanket further comprises an adhesive or polymeric microspheres between said printing layer and support layer.

25. The composition of claim 20 wherein print transfer information is recorded on portions of said printing layer which are disposed upon portions of said support layer that are adjacent to portions of said substrate bearing information indicating an absence of print in said image to be printed.

26. The composition of claim 25 wherein said print transfer information comprises said image to be printed.

27. The composition of claim 25 wherein said print transfer information comprises a negative of said image to be printed.

28. The composition of claim 25 wherein said print transfer information comprises an outline of said portion of said printing layer to be removed.

* * * * *

UNITED STATES PATENT AND TRADEMARK OFFICE

CERTIFICATE OF CORRECTION

PATENT NO. : 5,974,974
DATED : November 2, 1999
INVENTOR(S) : Agnew, et al.

It is certified that error appears in the above-identified patent and that said Letters Patent is hereby corrected as shown below:

Column 8,
Claim 1,
Line 17, delete [and]
Lines 18 and 19, delete [wherein: said printing layer is formed from a fully cured polymer;] and insert -- and polymeric microspheres between said printing layer and said support layer; wherein: said printing layer is formed from a fully cured polymer; --

Claim 8,
Lines 43 and 44, delete [or polymeric microspheres]

Claim 9,
Lines 47 and 48, delete [ a support layer;] and insert -- a support layer and polymeric microspheres disposed between said printing layer and said support layer; --

Column 9,
Claim 13,
Line 2, delete [or polymeric microspheres]

Claim 20,
Line 23, delete [;] and insert -- and polymeric microspheres disposed between said printing layer and said support layer; --

Column 10,
Claim 24,
Lines 13 and 14, delete [or polymeric microspheres]

Signed and Sealed this

Second Day of October, 2001

*Attest:*

Nicholas P. Godici

NICHOLAS P. GODICI
*Acting Director of the United States Patent and Trademark Office*

*Attesting Officer*